US005192374A

United States Patent [19]

Kindler

[11] Patent Number: 5,192,374

[45] Date of Patent: Mar. 9, 1993

[54] CHROMIUM-FREE METHOD AND COMPOSITION TO PROTECT ALUMINUM

[75] Inventor: Andrew Kindler, San Marino, Calif.

[73] Assignee: Hughes Aircraft Company, Los Angeles, Calif.

[21] Appl. No.: 766,319

[22] Filed: Sep. 27, 1991

[51] Int. Cl.[5] ..... C23C 22/56

[52] U.S. Cl. ..... 148/272; 148/273; 148/275

[58] Field of Search ..... 148/272, 273, 275; 106/14.21

[56] References Cited

U.S. PATENT DOCUMENTS

| | | | |
|---|---|---|---|
| 2,512,493 | 6/1950 | Gide | 148/275 |
| 4,711,667 | 12/1987 | Bibber | 106/14.21 |
| 4,878,963 | 11/1989 | Bibber | 148/262 |
| 4,988,396 | 1/1991 | Bibber | 148/273 |
| 4,992,115 | 2/1991 | Ikeda | 148/261 |

OTHER PUBLICATIONS

Hinton et al., "Cerium Conversion Coatings for Corrosion Protection of Aluminium", Materials Forum, vol. 9, No. 3 (1986), pp. 162–173.

*Primary Examiner*—Shrive Beck
*Assistant Examiner*—Terry J. Owens
*Attorney, Agent, or Firm*—Mary E. Lachman; M. W. Sales; W. K. Denson-Low

[57] ABSTRACT

An method of providing a protective coating on the surface of aluminum or aluminum alloys, comprising: removing contaminants from the surface; exposing the surface to water at 50° to 100° C. to form a porous boehmite coating on the surface; and exposing the boehmite-coated surface to an aqueous solution comprising a cerium salt and a metal nitrate at a temperature of 70° to 100° C. Oxides and hydroxides of cerium are formed within the pores of the boehmite to provide the protective coating, which provides corrosion resistance and improved paint adhesion.

17 Claims, No Drawings

CHROMIUM-FREE METHOD AND COMPOSITION TO PROTECT ALUMINUM

BACKGROUND OF THE INVENTION

1. Field of the invention

The present invention relates to a method and composition for providing the surface of aluminum and its alloys with a coating to protect against corrosion or to improve adhesion of paint. In particular, the invention relates to a composition and method that use cerium salts to provide an improved coating on aluminum and aluminum alloys.

2. Description of the Background Art

Aluminum and aluminum alloys are frequently used to form structures, such as for aircraft, in which corrosion resistance is required or in which good paint adhesion is required. Aluminum has a natural oxide film which protects it from many corrosive influences. This natural oxide is, however, not sufficiently resistant to such highly corrosive environments as saltwater, nor is it a good base for paints. Improved films, which are both more corrosion resistant and suitable as a base for paints can generally be formed on the surface of aluminum either by anodizing or by chromate conversion. During the anodizing process, aluminum oxide is formed on the aluminum surface, and provides a very corrosion resistant surface which can be dyed or painted. However, anodizing has the disadvantages of high electric resistance, higher cost, longer processing time, and the need to make direct electrical contact with the part. This latter requirement complicates processing considerably.

Chromate conversion coatings are formed by dipping the aluminum part in chromatic acid, to provide a coating comprising chromium oxide(s) mixed with aluminum oxide. Chromate conversion coatings are corrosion resistant, provide a suitable base for paint, can be rapidly applied, self-heal when scratched, and are very cheap. Furthermore, chromate coatings are reasonably conductive and can be used in sealing surfaces for electromagnetic interference gaskets. The conductive characteristics provided by chromate conversion coating are not characteristic of anodized coatings nor of most protective coatings. Unfortunately, the hexavalent chrome used in producing these cheap, reliable and useful coatings poses serious health hazards as well as significant disposal problems. Dermatitis and skin cancer have been associated with the mere handling of chromated aluminum parts. Severe damage to mucous membranes and skin lesions called "chrome sores" occur from exposure to the ever-present chrome mist in plating shops. Such health hazards to humans represent a major problem in the use of chrome for protecting aluminum. Thus, it would be desirable to replace the chromating process entirely.

A recently developed process which eliminates the use of chromium involves coating aluminum surfaces with a film of aluminum oxhydroxide (pseudo boehmite), as disclosed in U.S. Pat. No. 4,711,667 for "Corrosion Resistant Aluminum Coating". This process yields a coating which is not as conductive as a chromate conversion coating, but is not, however, an insulator. In addition, its corrosion resistance is not as good as that produced by chromate conversion. The details of this known process are discussed in Example 1 herein.

In another known method, aluminum has been treated with cerium chloride, $CeCl^3$, to form a mixed cerium oxide/cerium hydroxide film on the surface, as described, for example, by Hinton, et al., in the publication "Cerium Conversion Coatings For The Corrosion Protection of Aluminum," *Materials Forum*, Vol. 9, No. 3, pages 162–173 (1986). In this process, a coating of cerium oxide/hydroxide is precipitated on the aluminum surface and provides a relatively high degree of corrosion resistance. Unfortunately, this process is slow, taking almost 200 hours. The speed of the process can be improved so that the coverage occurs in 2 to 3 minutes by cathodically polarizing the coupon. However, this leads to a less durable coating, and the process is inconvenient because it requires the use of electrodes.

Thus, it would be desirable to provide a chromium-free process for providing aluminum and aluminum alloys with a protective coating which is rapid and does not involve the use of electrodes.

SUMMARY OF THE INVENTION

The present invention is directed to a method of protecting the surfaces of aluminum or aluminum alloys with a chromate-free protective coating to provide corrosion resistance or paint adhesion to the treated surface. The method uses a composition comprising a cerium salt and does not involve the use of electrodes which would galvanostatically polarize the contact between the aluminum and the aqueous treatment solution.

The method in accordance with the present invention comprises first removing contaminants from the surface of the aluminum or aluminum alloy. Next, the cleaned surface is exposed to deionized water at about 50° to 100° C. to form a porous boehmite coating on the surface of the aluminum. Then the surface having the boehmite coating is exposed to an aqueous solution comprises a salt of cerium and a metal nitrate at about 70° to 100° C. for a sufficient time to form oxides and hydroxides of the cerium within the pores of the boehmite coating. The resulting coating is resistant to corrosion and has good paint adhesion. Optionally, a silicate sealant layer may be added. The present invention further encompasses the above-noted aqueous solution for treating aluminum or aluminum alloy surfaces to provide a protective coating.

The above-discussed and many other features and attendant advantages of the present invention will become better understood by reference to the following detailed description of the invention.

DESCRIPTION OF THE PREFERRED EMBODIMENTS

In accordance with the method of the present invention, the aluminum surface to be treated is first cleaned to remove any contaminants on the surface. This first cleaning step may comprise, for example, contacting the surface with an alkaline cleaning composition for a sufficient period of time to remove substantially all the grease inhibitors or other contaminants that might interfere with the coating method of the present invention. Such grease inhibitors are located on the surface of the aluminum. In addition, the surface to be treated may be cleaned by treatment with a deoxidizing agent to remove substantially all of the oxide inhibitors which might adversely affect the coating method described herein. These deoxidizing agents also remove any smut from undissolved alloying components such as copper. The oxide inhibitors are located on the surface of the aluminum. Other known processes for removing contaminants from the surface of aluminum or aluminum alloys may also be used in accordance with the present invention.

After the surface to be treated has been cleaned to be free of contaminants, the cleaned surface is exposed to deionized water at about 50° to 100° C. to oxidize the aluminum and form a porous boehmite coating, comprising aluminum oxyhydroxide. Optionally, this oxidation step may be performed at a temperature as low as room temperature.

Next, the surface with the boehmite coating is exposed to an aqueous solution comprising a salt of cerium and a metal nitrate at a temperature within the range of about 70° to 100° C. The metal nitrate produces further oxidation of the aluminum. While not limiting the present invention to a particular theory of operation, it is believed that the cerium salts penetrate into the porous boehmite structure where they are reacted to form cerium oxides and cerium hydroxide. It is believed that these cerium oxides and hydroxides plug the pores in the boehmite to thereby provide the improved protective coating.

The cerium salt used in the present method is chosen from the group consisting of cerium chloride, cerium nitrate, and cerium sulfate, and is preferably cerium chloride. The concentration of the cerium salt in the aqueous composition is from about 0.01% to about 1% by weight, preferably about 0.1%.

The metal nitrate used in the present method includes, but is not limited to, lithium nitrate, aluminum nitrate, ammonium nitrate, sodium nitrate, or mixtures thereof, preferably lithium nitrate and aluminum nitrate. The total amount of nitrate(s) is preferably between about 0.2% to 10% by weight. In a preferred embodiment, the aqueous solution includes both aluminum nitrate and lithium nitrate. The concentration of lithium nitrate in this preferred solution is from about 0.1% to about 5%, preferably about 1% by weight. The aluminum nitrate concentration in the preferred solution is from about 0.1% to 5%, preferably about 1% by weight. The pH of the aqueous solution of the present invention is maintained in the range of about 3.5 to about 4, and preferably about 4.

The temperature at which the surface with the boehmite coating is exposed to the aqueous solution of the cerium salt and the metal nitrate(s) is within the range of about 70° to 100° C., preferably about 97°-100° C. The temperature may be decreased below the preferred range with corresponding reduction in the rate of reaction. For a treatment temperature of about 97°-100° C., this process step may be completed in about 5 minutes. For lower temperatures, longer time periods will be required to complete this process step.

Optionally, the present method may include the further step of exposing the treated surface to a solution of a silicate compound, such as 10 percent by weight potassium silicate at 90° C. to 95° C. for about 1 to 1.5 minutes, to provide a final silicate sealant layer, as described in Example 1.

The present invention further comprises the above-discussed aqueous composition comprising a cerium salt and metal nitrate which is used in the present method.

The coatings formed in accordance with present invention protect the treated surface to provide corrosion resistance as discussed in Example 1 or to provide improved paint adhesion as discussed in Example 2.

Examples of practice of the present invention are as follows.

EXAMPLE 1

The method in accordance with the present invention provides an improvement on the known process disclosed in U.S. Pat. No. 4,711,667, previously discussed in the "Description of Related Art" herein, and referred to hereinafter as the "Sanchem process." In this example, the corrosion resistance of samples treated in accordance with the present invention is compared to the corrosion resistance of samples treated in accordance with the Sanchem process.

The Sanchem process was practiced by treating aluminum alloy coupons type 2024-T3, having dimensions of 3 inches by 10 inches (7.6 cm by 25.4 cm), by the following steps:

Step 1. Clean coupon in alkaline cleaner, such as CHEMIDIZE 740 (obtained from Sanchem Inc.) at 71° C. for 3 minutes.
Step 2. Rinse 1 minute with deionized (D.I.) water.
Step 3. Deoxidize at 30° C.-35° C. for 20 minutes in a mixture of 10% nitric acid and 3% sodium bromate.
Step 4. Rinse 1 minute in D.I. water.
Step 5. Place in D.I water at 97° C.-100° C. for 5 minutes.
Step 6. Place in solution of 1% lithium nitrate and 1% aluminum nitrate at 97° C.-100° C. for minutes.
Step 7. Rinse in D.I. water.
Step 8. Place in solution of 0.25% $KMnO_4$ for 5 minutes at 57° C.-60° C.
Step 9. Rinse in D.I. water.
10. Place in solution of 10% potassium silicate at 90° C.-95° C. for 1-1.5 minutes.
Step 11. Rinse in D.I water.
Step 12. Blow dry.

In accordance with a preferred embodiment of the present invention, the aluminum alloy coupons (type 2024-T3) were pre-treated as described in steps 1 through 5 above. Then the cleaned coupon was exposed to the composition of the present invention and dried. Thus, the present process eliminated steps 8 through 11 in the Sanchem process, which required treatment with potassium permanganate and an additional sealing step with potassium silicate.

The specific treatment steps used in accordance with the present invention were as follows:

1. Clean coupon in alkaline cleaner (CHEMIDIZE 740) at 71° C. for 3 minutes.
2. Rinse 1 minute in deionized water.
3. Deoxidize at 30° C. to 35° C. for 20 minutes in a mixture of 10% nitric acid and 3% sodium bromate.
4. Rinse 1 minute in deionized water.
5. Place in deionized water at 97° C. to 100° C. for 5 minutes.
6. Place in solution of 0.1% cerium chloride, 1% lithium nitrate, and 1% aluminum nitrate at pH of 4 at 97° C. to 100° C. for 5 minutes.
7. Blow dry.

Aluminum alloy coupons treated by each of the above-described processes were subjected to a salt spray test in accordance with the American Society for Testing and Materials B117 (Standard Method of Salt Spray (Fog) Testing), for 3 days at 95° C. The corrosion resistance of the coupons treated in accordance with the present process was as good as the corrosion resistance of the coupons treated in accordance with the Sanchem process. The quality of the corrosion resistance was determined using the measurement standards of MIL-C-5541 (Chemical Conversion Coatings on Aluminum and Aluminum Alloys). Thus, the present process provides good corrosion resistance while eliminating the steps of treatment with potassium permanganate and with a sealant, to thereby reduce processing time and costs.

In addition, various modifications of the Sanchem process and of the present process were made and these modifications are summarized in Table 1. Treatment $M_1$ employed the preferred method of the present invention set forth above. Treatment $M_2$ was the same as $M_1$ except only steps 10 and 11 of the Sanchem process were deleted. Similar variations to the Sanchem process are identified in Table 1 as $S_1$ and $S_2$. In $S_1$, steps 8–11 of the Sanchem process were deleted. In $S_2$, steps 10 and 11 were deleted from the Sanchem process.

TABLE I

| PROCESS VARIATIONS | |
|---|---|
| $M_1$ | Present process (preferred).<br>Addition of 0.1% $CeCl_3$ to Step 6 of Sanchem process; deletion of Steps 8–11 of Sanchem process. |
| $M_2$ | Present process (Altered).<br>Addition of 0.1% $CeCl_3$ to Step 6 of Sanchem process; deletion of Steps 10 and 11 of Sanchem process. |
| $S_1$ | Sanchem process.<br>Deletion of Steps 8–11. |
| $S_2$ | Sanchem process.<br>Deletion of Steps 10 and 11. |

Corrosion resistance provided by the variations of the method of the present invention, $M_1$ and $M_2$, were compared with variations, $S_1$ and $S_2$, of the Sanchem process. The comparisons were made by subjecting treated aluminum alloy coupons, type 2024-T3, to a salt spray chamber for 8½ days at 95° C.

Two test were performed. In a first comparison treatment, $M_1$ was compared to treatment $S_1$. In the first test, the method of the present invention, $M_1$, gave better corrosion resistance than the $S_1$ treatment. In the second test, the method of the present invention $M_1$ gave about the same level of corrosion resistance as the $S_2$ treatment. These results indicate that the method of the present invention, treatment $M_1$, can produce the same or even better corrosion resistance than a Sanchem process which has been correspondingly modified to have fewer steps.

In addition, the method of the present invention, treatment $M_1$, was compared to treatment $M_2$ in which only steps 10 and 11 of the Sanchem process were deleted. The results showed that the additional steps 8 and 9 of the Sanchem process counteracted the corrosion resistance provided by cerium chloride salts introduced in accordance with the present invention. Accordingly, it is preferred that steps 8 and 9 of the Sanchem process be deleted, as has been done in accordance with the present invention.

Finally, the process of the present invention treatment $M_1$ was modified to include steps 10 and 11 of the Sanchem process to provide a final sealant. In addition, the deoxidization of step 3 above of the present process was performed at 24° C. (i.e., room temperature) for 40 minutes. The test samples were two aluminum alloy coupons, type 2024-T3. The treated samples were subjected to corrosion testing in accordance with ASTM B117, previously referenced, for a period of 168 hours. Good corrosion resistance was obtained for both samples, as indicated by applying the measurement standards of MIL-C-5541. In addition, the test results for the two test samples were very similar to each other.

For comparison purposes, two test samples from the same batch as used above were treated in accordance with the Sanchem process as previously described and subjected to the same corrosion testing as the samples treated in accordance with the present invention. One of these test samples had corrosion resistance as good as the samples treated in accordance with the present invention, and the other test sample was considerably worse than the sample treated by the present invention.

EXAMPLE 2

This example presents data showing that the method of the present invention provides the surface of the aluminum or aluminum alloy with a coating which provides good paint adhesion.

Test samples consisting of aluminum alloy coupons, 2024-T3 were treated in accordance with the present invention as previously indicated in Example 1 in steps 1 though 7. Paint was then applied to the treated test samples. The test samples passed the paint adhesion tests specified in Federal Standard 141 (Paint, Varnish, Lacquer, and Related Materials, Methods of Inspection, Sampling, and Testing) method 6301, as specified in MIL-C-5541, both before and after salt spray testing in accordance with ASTM B117. In addition, these samples passed a 180 bend test after salt spray testing.

It is apparent that many modifications and variations of this invention, as set forth above, may be made without departing from the scope of the present invention. The specific embodiments described herein are given by way of example only, and the invention is limited only by the terms of the appended claims.

What is claimed is:

1. A method for providing the surface of aluminum or aluminum alloys with a protective coating consisting of:

(a) removing contaminants from said surface of said aluminum or aluminum alloys to provide a cleaned surface;

(b) exposing said cleaned surface to deionized water at a temperature within the range of 50° to 100° C. to form a porous boehmite coating on said surface;

(c) exposing said surface with said boehmite coating to an aqueous solution comprising a salt of cerium and a metal nitrate at a temperature within the range of 70° to 100° C. for a sufficient period of time to form oxides and hydroxides of said cerium within the pores of said porous boehmite coating to thereby provide said protective coating.

2. The method of claim 1 wherein said salt of cerium is chosen from the group consisting of cerium chloride, cerium nitrate, and cerium sulfate.

3. The method of claim 1 wherein said salt of cerium comprises cerium chloride and the concentration of said salt of cerium is from about 0.01% to about 1% by weight.

4. The method of claim 1 wherein the concentration of said salt of cerium is about 0.1% by weight.

5. The method of claim 1 wherein said metal nitrate is chosen from the group consisting of lithium nitrate, aluminum nitrate, ammonium nitrate, sodium nitrate, and mixtures thereof.

6. The method of claim 5 wherein said aqueous solution comprises from about 0.1% to about 5% by weight lithium nitrate and from about 0.1% to about 5% by weight aluminum nitrate.

7. The method of claim 6 wherein the concentration of said lithium nitrate is about 1% and the concentration of said aluminum nitrate is about 1% by weight.

8. The method of claim 1 wherein said removing said contaminants comprises exposing said surface to an alkaline cleaning composition.

9. The method of claim 1 wherein said removing said contaminants comprises exposing said surface to a deoxidizing agent.

10. The method of claim 1 wherein the pH of said aqueous solution is in the range of about 3.5 to about 4.

11. The method of claim 1 further comprising after step (c), exposing said surface with said protective coating to a metal silicate solution at a temperature of about 90° to 95° C. for a sufficient period of time to form a final sealant layer.

12. The method of claim 1 wherein said protective coating provides resistance to corrosion.

13. The method of claim 1 wherein said protective coating provides a surface for adhesion of paint.

14. A composition for providing the surface of aluminum or aluminum alloys with a protective coating in accordance with the method of claim 1, said composition consisting of an aqueous solution of from about 0.01% to about 1% by weight of cerium salt, and from about 0.2% to about 10% by weight of a metal nitrate.

15. The composition of claim 14 wherein said cerium salt is chosen from the group consisting of cerium chloride, cerium nitrate, and cerium sulfate.

16. The composition of claim 14 wherein said metal nitrate is selected from the group consisting of lithium nitrate, aluminum nitrate, ammonium nitrate, sodium nitrate, and mixtures thereof.

17. The composition according to claim 14 wherein said solution comprises about 0.1% by weight cerium chloride, 1.0% by weight lithium nitrate and 1.0% by weight aluminum nitrate.

* * * * *